United States Patent [19]

Bedwell et al.

[11] 4,418,100

[45] Nov. 29, 1983

[54] APPARATUS AND METHOD FOR REDUCING SPANGLE IN GALVANIZED PRODUCTS

[75] Inventors: Junion L. Bedwell; Harold C. Overton, both of Gadsden, Ala.

[73] Assignee: Republic Steel Corporation, Cleveland, Ohio

[21] Appl. No.: 344,998

[22] Filed: Feb. 2, 1982

[51] Int. Cl.[3] ..... B05D 3/04; B05D 3/12; B05D 1/18

[52] U.S. Cl. ..... 427/348; 118/63; 118/67; 118/69; 118/419; 427/349; 427/398.1; 427/398.3; 427/433

[58] Field of Search ..... 118/63, 419, 69, 67; 427/349, 433, 398.3, 398.4, 398.1, 348

[56] References Cited

U.S. PATENT DOCUMENTS

| | | | |
|---|---|---|---|
| 2,094,583 | 10/1937 | Cook et al. | 427/398.3 X |
| 3,056,694 | 10/1962 | Mehler et al. | 117/114 |
| 3,148,080 | 9/1964 | Mayhew | 427/398.4 |
| 3,322,560 | 5/1967 | Monaco | 427/398.3 |
| 3,369,923 | 2/1968 | Laidman | 427/349 X |
| 3,428,023 | 2/1969 | Cox et al. | 118/68 |
| 3,561,096 | 2/1971 | Krengel et al. | 427/349 X |
| 3,608,520 | 9/1971 | Caldwell et al. | 118/60 |
| 3,717,501 | 2/1973 | Caldwell et al. | 117/102 M |
| 3,743,535 | 7/1973 | Padjen et al. | 118/69 X |
| 3,756,844 | 9/1973 | Bunnell et al. | 118/63 X |
| 3,782,326 | 1/1974 | Faggotter | 118/67 |
| 3,782,909 | 1/1974 | Cleary et al. | 427/398.3 X |
| 3,808,033 | 4/1974 | Mayhew | 427/398.4 X |
| 3,809,570 | 5/1974 | Herman | 118/325 X |
| 3,853,306 | 12/1974 | Padjen et al. | 118/69 X |
| 4,041,895 | 8/1977 | Overton et al. | 118/419 X |
| 4,171,394 | 10/1979 | Patil et al. | 118/63 X |
| 4,173,663 | 11/1979 | Bostroem | 427/211 |
| 4,346,129 | 8/1982 | Decker et al. | 118/63 X |

*Primary Examiner*—Michael R. Lusignan

*Attorney, Agent, or Firm*—Watts, Hoffmann, Fisher & Heinke

[57] ABSTRACT

A method and apparatus are disclosed for reducing spangle in a galvanization system that utilizes air knives to control coating thickness and distribution. Cooling nozzles are located downstream of the air knives along the feed path of the substrate being coated. The cooling nozzles direct an air and water mixture against the substrate at approximately the location the air from the air knives impinge the substrate. The air from the air knives force the air and water mixture to be carried along the substrate surface in a direction of the substrate feed path.

18 Claims, 3 Drawing Figures

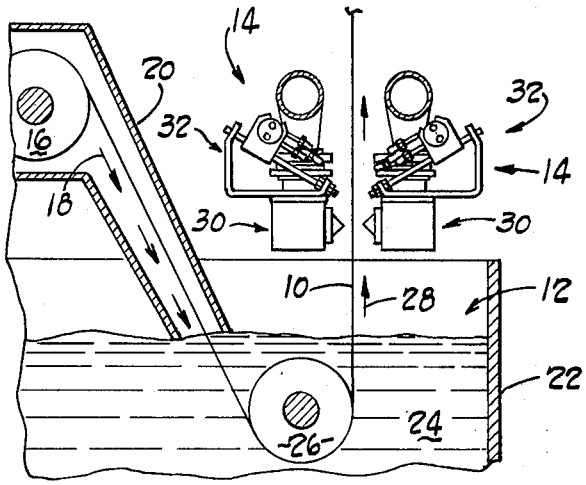
Fig. 1
Fig. 3
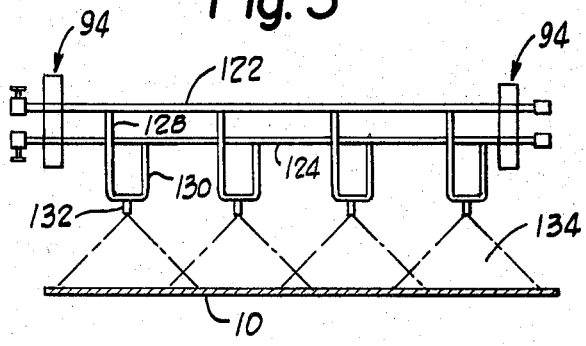

APPARATUS AND METHOD FOR REDUCING SPANGLE IN GALVANIZED PRODUCTS

DESCRIPTION

TECHNICAL FIELD

The present invention relates to a method and apparatus for reducing spangle in galvanized products and is more particularly directed to a method and an apparatus that reduce spangle in hot galvanizing systems that utilize air knives to control coating thickness and distribution on a substrate moving along a feed path.

BACKGROUND ART

In a "hot dip" coating process, a moving substrate such as steel is coated with a corrosion resistant material such as zinc by feeding the substrate through a coating bath. The substrate emerges from the bath along a generally upward, vertical feed path with molten coating material deposited on its surfaces.

The profile of the coating deposited on the substrate must be controlled to assure a substantially uniform coating on the resultant product. Profile control is also important to prevent wasteful deposition of excessively thick coatings and to assure that the coated substrate will perform in a consistent and desired manner in such handling processes as coiling, stacking and shipping, and in such fabrication processes as die forming and welding.

There are two aspects of profile control which require careful regulation. The first aspect is coating thickness which is expressed in the art as coating "weight". Coating thickness is specified in ounces per square foot, when a coated product is ordered. The second aspect is coating distribution which is often non-uniform in cross-section across the width of the substrate.

The crystalline structure of the coating material formed as the coating solidifies must also be controlled. A problem well known in the art is caused when crystal aggregates spread out from nuclei and join each other to form a more or less regular pattern resembling somewhat the appearance of a frosted window pane. This crystal formation is known as "spangle."

The prior art has disclosed several ways of controlling the thickness of the coating material and the spangle that occurs during solidification of the coating material.

U.S. Pat. No. 4,041,895 to Overton et al issued Aug. 16, 1977 and assigned to the same assignee of the present invention teaches the use of air knives to control the coating thickness. The air knives discharge a pressurized fluid such as air onto a moving substrate that emerges from a coating bath. The pressurized air screeds excess coating material from the substrate leaving a coating material deposit having a desired thickness and distribution.

One common process of cooling the coating material on the substrate taught by the prior art is by the use of a water spray impinged onto the coated substrate a distance downstream from the profile control device along the substrate feed path, which aids in solidifying the coating material. This cooling process improves the size of the spangles on the finished galvanized product. One approach made use of a water spray to cool the coating material in conjunction with the use of air knives to control the coating thickness and distribution. This was done by directing a water spray against an inclining surface of the air knife nozzle assembly so the water spray was deflected toward the coated substrate surface. This technique however has not proved to work in a satisfactory manner to obtain reliable, superior, surfaces having reduced spangle size.

An object of the present invention is to provide a new and improved method and apparatus for use in combination with an air knife thickness and distribution control device that will provide improved spangle control during the solidification of a coating material on a substrate.

DISCLOSURE OF THE INVENTION

The invention provides a new and improved method and apparatus for improving spangle control during hot galvanization processing of a substrate in which an air knife is used to control coating thickness and distribution. The new method and apparatus are designed to cool the coating material close to the location at which air from the air knife impinges against the substrate and to have the air from the air knife force a cooling substance to flow along the coated substrate surface in the direction of the feed path of the substrate.

The apparatus of the present invention for controlling coating thickness and reducing spangle of a coated substrate as it moves along a feed path comprises an air knife located generally perpendicular to the substrate and a cooling jet downstream from the air knife. The air knife discharges pressurized air generally perpendicular the substrate surface to screed coating material from the substrate leaving a coating of desired thickness and distribution. A means including a nozzle is provided for discharging a gas and liquid mixture toward the substrate to cool the coating material after the air knife screeds the coating material and thereby reduce spangle. The nozzle is positioned to discharge the gas and liquid mixture toward the substrate in proximity to the location at which air from the air knife impinges on the substrate. The air from the air knife materially affects the flow of the cooling mixture. In particular, the air from the air knife forces the cooling mixture to flow and be carried along the coated substrate surface in the direction of the feed path.

The method of the present invention for reducing spangle on a coated substrate that has been screeded by an air knife, comprises the step of directing a gas and liquid spray directly toward the coated substrate at a location sufficiently close to where air from the air knife has impinged the coated substrate to have the air from the air knife materially affect the spray flow.

In the preferred embodiment, a substrate sheet or strip being coated emerges from a molten zinc bath in preferably an upward, vertical flow path. Air knife assemblies are located on each side of the emerging coated substrate above the molten bath. The air knives must be located sufficiently close to the molten bath so the coating material on the substrate is still molten by the time it reaches the air knife location. The air knives discharge pressurized air against the coated substrate surface to screed excess coating material and to distribute the coating material along the substrate surface. The air knives thus control the thickness and distribution of the coating material on the substrate surface.

Cooling nozzle assemblies are preferably mounted to each of the air knife assemblies. Nozzles are mounted to each air knife assembly, oriented at an angle downward and toward the strip surface, by use of L-shaped brackets. The cooling nozzle assemblies are located down stream of the air knife assemblies along the substrate feed path of the coated strip.

Each cooling nozzle assembly has two inlet manifolds, one for air and one for water. Each of a plurality of nozzles is connected to both of the inlet manifolds. Air and water enter each nozzle and are mixed. The nozzles discharge a spray of cooling air and water mixture. The nozzles are directed at such an angle to the coated substrate surface that the cooling mixture is discharged toward the coated surface at approximately, but slightly downstream from, the location at which air from the air knives impinges the substrate surface. The air from the air knives forces the cooling mixture to flow along the coated substrate surface in the direction of the substrate feed path. This early cooling of the coating material plus the lengthened time of cooling provided by essentially lamellar flow of the cooling mixture along the substrate surface has been found to significantly reduce spangle on the coated product.

The above and other features and advantages of the invention will become better understood from the following detailed description and the accompanying drawings.

BRIEF DESCRIPTION OF THE DRAWINGS

FIG. 1 is a schematic view of an apparatus of two air knife assemblies and cooling nozzle assemblies embodying the present invention;

FIG. 3 is a schematic view of cooling jets as seen from a plane indicated by a line 3—3 in FIG. 2.

BEST MODE FOR CARRYING OUT THE INVENTION

Figure 2:
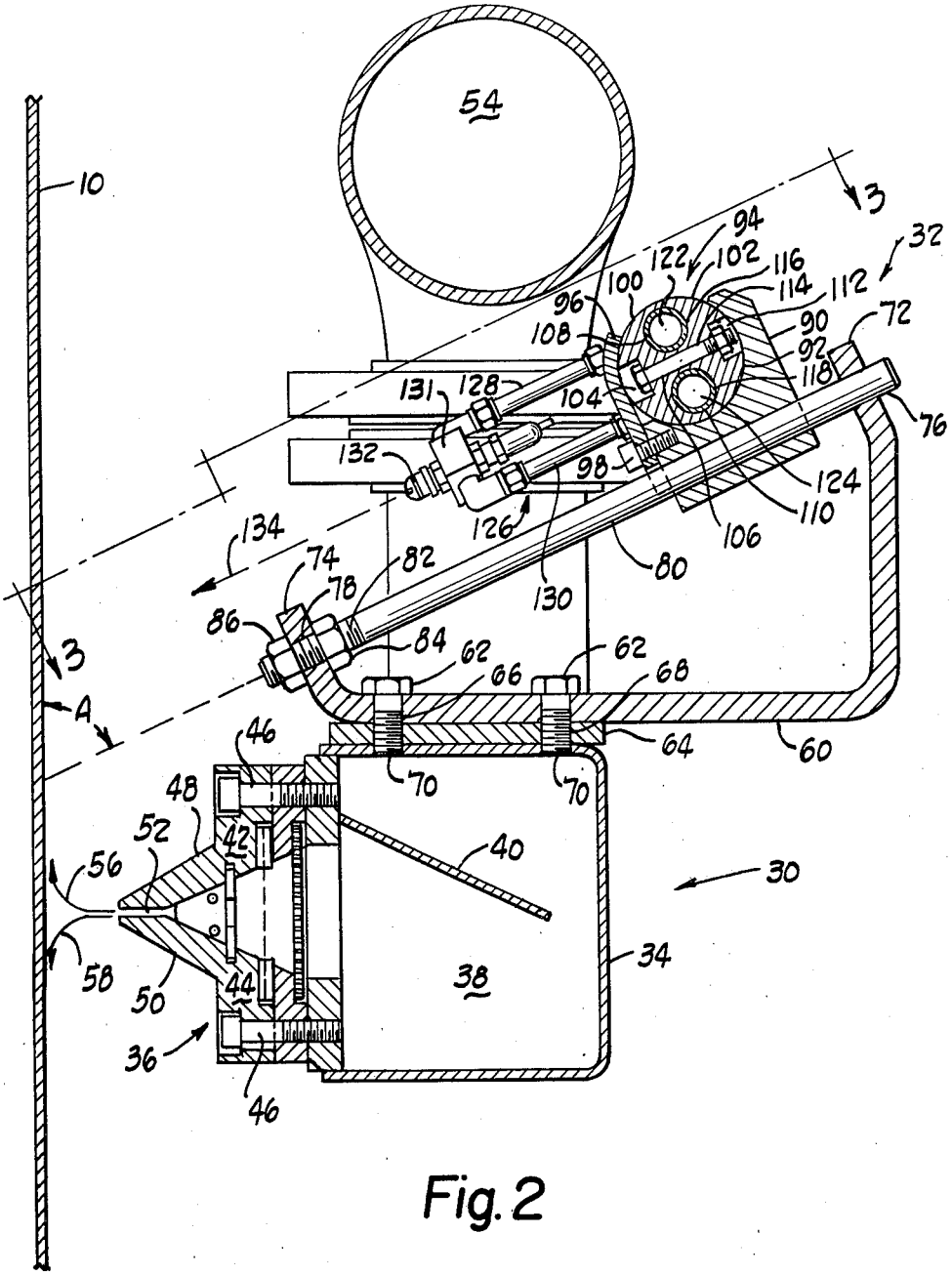
FIG. 2 is an enlarged sectional view of an air knife assembly and a cooling nozzle assembly shown in FIG. 1.

Referring to FIG. 1, in the preferred practice of the present invention, a moving substrate sheet 10 is coated by feeding it through a molten coating bath 12. As the substrate 10 exits from the coating bath 12 along a feed path, it carries molten coating material in excess of the desired final coating thickness. The excess coating material is removed by a pair of coating control assemblies 14 which discharge pressurized air onto opposite sides of the substrate 10 to screed and establish a desired coating thickness and distribution on the substrate. The coated substrate 10 is cooled by a pressurized gas and liquid mixture directed adjacent the location on the substrate at which the pressurized air screeds the excess coating material therefrom. The cooling gas and liquid mixture is forced by the screeding air from the control assembly to flow along the substrate surface in the direction of the feed path of the substrate. The cooling mixture reduces the temperature of the coating material below its melting point thus solidifying the deposited coating on the substrate. In a conventional "hot dip" galvanizing process, which utilizes steel as a substrate and zinc as a coating material, this manner of cooling greatly reduces spangle.

As illustrated in FIG. 1, the steel substrate sheet 10 is fed over a roller 16 as it exits from a conventional cleaning and/or annealing apparatus not shown. The steel substrate 10 travels in a direction indicated by arrows 18 through a controlled atmosphere snout 20 and into a receptacle 22 containing molten zinc coating material 24. The steel substrate 10 is fed around a sink roller 26 journaled at a submerged position in the coating bath 12. From the sink roller 26, the steel substrate 10 travels upwardly and exits the coating bath 12 along an approximately vertical feed path, as indicated by arrows 28.

The coating control assemblies 14 comprise air knife assemblies 30 and cooling nozzle assemblies 32, the latter being located down stream from the air knife assemblies with respect to the feed path 28. The air knife assemblies 30 discharge pressurized fluid against opposite sides of the moving substrate 10 to screed excess coating material from the substrate, leaving only that required to provide a desired coating thickness and distribution. The pressure profiles of the air discharged from the air knife assemblies 30 are controlled to provide a controlled screeding of the coating material. Any of a wide range of coating thicknesses and distributions can be established on the substrate sheet 10 by controlling the pressure profiles of the air discharge from the air knife assemblies 30. A detailed explanation of the structure and functioning of air knife assemblies such as those used in the present invention is fully disclosed in U.S. Pat. No. 4,041,895 to Overton et al, which is hereby fully incorporated herein by reference.

The structure and operation of the coating control assemblies 14 will be best understood with reference to FIG. 2. The coating control assemblies 14 are mirror image structures. Therefore, the structure and operation of one such assembly will be described, it being understood that the other assembly is constructed and operates similarly. Each assembly 30 comprises a housing 34, an air knife 36 of any suitable or conventional construction, and a knife plenum chamber 38, that includes a baffle 40. The housing 34 and the air knife 36 extends the width of the substrate sheet 10. In this preferred embodiment, the air knife 36 includes an upper knife lip support 42 and a lower knife lip support 44 attached by cap screws 46 to the knife plenum chamber 38. Knife lips 48, 50 define a discharge orifice 52.

Pressurized air enters the air knife assembly 30 through a manifold 54. The air then passes through a connecting duct, not shown, and enters into the air knife plenum chamber 38. After flowing around the baffle 40, the air flow is focused by the knife lips 48, 50 and exits through the discharge orifice 52. The pressurized air that is discharged then impinges against the coated substrate 10.

The air knife 36 is designed to assure that the pressurized air exiting the orifice 52 has a predetermined profile. By controlling the pressure profile of the air discharging from the air knife 36, a corresponding controlled coating profile is obtained on the substrate 10. The molten zinc will be screeded from the substrate surface by the air pressure and will leave a coating that has a thickness that is a function of the air pressure profile. The pressurized air impinging upon the substrate 10 subsequently flows along the coated substrate surface in both vertical directions as indicated by arrows 56, 58.

The cooling nozzle assembly 32 includes preferably two L-shaped mounting brackets 60 which are fixedly attached to opposite ends of housing 34 by use of bolts 62. A spacer plate 64 is used to adjust the verticale displacement between the air knife assembly 30 and the cooling nozzle assembly 32. The bolts 62 extend through aligned holes 66, 68 and are threaded into threaded openings 70 of the housing 34. Each L-shaped bracket 60 has parallel flanges 72, 74 at the ends of the bracket. Preferably, these flanges are an integral part of the L-shaped brackets 60. The flanges of each bracket have aligned apertures 76, 78.

A mounting rod 80 extends through the apertures 76, 78 for each bracket 60. Each mounting rod 80 has a threaded portion 82. Nuts 84, 86 are provided to secure each mounting rod 80 to its associated L-shaped bracket 60. As will be apparent, not only do the nuts 84, 86 provide a means for securing each rod to its flanges, this arrangement permits each rod to be longitudinally adjusted in a direction perpendicular to the flanges.

The flanges 72, 74 of each L-shaped mounting bracket 60 are angled from the mounting brackets so that a normal to a plane defined by the two parallel mounting rods 80 will be directed at an acute angle A with respect to the substrate 10, intersecting with the feed path just slightly downstream from where the air knife flow impinges.

Two support members 90 each having a semi-circular recieving portion 92 are slidably attached, one to each mounting rod 80. Two circular manifold support assemblies 94 are received, one in each receiving portion 92. Two securing members 96 are fixed, one to each support member 90, by a threaded fastener 98. The manifold support assemblies 94 will thus be secured to the support members 90. It will be appreciated that the support manifolds are rotatably adjustable relative to the receiving portions 92. The securing members 96 are dimensioned to permit rotation of the manifold support assemblies when the threaded fasteners are loosened and to prevent rotation of the manifold support assemblies when the threaded fasteners are tightened.

Each manifold support assembly 94 comprises a first member 100 and a second member 102. The first member 100 has a recessed portion 104, a through hole 106, and two arcuate recessed areas 108, 110. The second member 102 has a corresponding recessed area 112, a through hole 114 and two arcuate recessed areas 116, 118. The two members 100 and 102 are held together by a fastener 120.

Two manifolds 122, 124 are held in position by the arcuate recessed areas of members 100, 102. These manifolds run the length of the air knife assembly 30. One of the manifolds is provided to carry pressurized air and the other is used to carry pressurized water.

A plurality of nozzle assemblies 126 are provided along the length of the manifolds between the L-shaped brackets. Each nozzle assembly 126 includes conduits 128, 130, which are connected to manifolds 122, 124 respectively. A mixing chamber 131 for each nozzle assembly 126 mixes the air and the water received from the conduits. A nozzle 132 extends from each mixing chamber and of which discharges an air and water mixture in a form of a fan spray 134, which is also referred to as a cooling jet, toward the coated substrate 10. As will be appreciated, the angle at which the cooling jets 134 are directed toward the substrate can be adjusted by rotation of the manifold support assemblies 94. The nozzles which are located downstream from the air knives, along the substrate feed path are directed at an angle so that the sprays are aimed upstream.

Referring now to FIG. 3, the pattern of the gas and liquid spray from each nozzle 132 can be better appreciated. As seen from the schematical representation, the nozzles spray a fan pattern. The nozzles are preferably located sufficiently close to each other and/or the fan angles are large enough that the spray patterns overlap.

The present invention contemplates that the cooling jets 134 which are directed upstream impinge the coated substrate surface in proximity to where the pressurized air from air knife 36 impinges upon the coated substrate 10. In this application, impingement of the cooling jets from nozzle 132 in proximity to where the air from an air knife 36 impinges the substrate means at a location along the substrate surface where the discharged air from the air knife will cause the gas and liquid mixture to be carried along and to flow along the substrate surface in the direction of the substrate feed path.

In particular, the air flow designated by arrow 56 from the air knife 36, will cause the air and water mixture from each nozzle to flow along the surface of the coated substrate in the direction of the feed path 28. The cooling jets are thus directed toward the substrate and are carried along by the air flow from the air knife in the direction of substrate movement. The cooling mixture from each nozzle thus remains in contact with the coated substrate surface and continues to cool the molten zinc as it moves along the feed path 28 with initial contact being within proximity of the screeding location. It has been found that this cooling technique vastly decreases the spangle present on the coated surface once the coating material is completely solidified.

Other modifications and variations of the invention will be apparent to those skilled in the art in view of the foregoing detailed disclosure. Therefore, it is to be understood that, within the scope of the appended claims, the invention can be practiced otherwise than as specifically shown and described.

We claim:

1. An apparatus for controlling coating thickness on a substrate and reducing spangle as the substrate moves along a feed path, said apparatus comprising:

an air knife located to discharge pressurized air generally perpendicular to said substrate to screed coating material from said substrate leaving a coating of desired thickness and distribution; and means including a nozzle for discharging a gas and liquid mixture toward said substrate to cool the coating material after said air knife screeds said coating material and thereby reduce spangle;

said nozzle being positioned to discharge said gas and liquid mixture toward said substrate in proximity to the location at which air from said air knife impinges on said substrate so that said air will materially affect the flow of said gas and liquid mixture.

2. The apparatus of claim 1 wherein said air from said air knife causes said gas and liquid mixture to flow along the coated substrate in the direction of substrate movement.

3. An apparatus for applying a galvanizing coating of molten metal to a moving strip by passing the strip through the molten metal and for reducing spangle, said apparatus comprising:

an air knife extending across a path along which the coated strip is moved, said knife constructed and arranged to apply a flow of air substantially perpendicular to the strip to control the thickness and distribution of the coating; and means for applying an air and water mixture to the coated strip at an angle to the path adjacent and slightly downstream of the location of air impingement of the air knife where the flow from the air knife will carry the mixture in the direction of the strip movement.

4. The apparatus of claim 3 wherein said means is a plurality of nozzles directed toward the location of air impingement of the air knife.

5. The apparatus of claim 4 wherein said plurality of nozzles has a common air supply and a common water supply.

6. In an apparatus for applying coating material to a substrate, in which an air knife is used to control thickness and distribution as the substrate moves along a feed path, the improvement comprising:

means for spraying a gas and liquid mixture toward said substrate at a location where air from said air knife materially affects the flow of the spray of said gas and liquid mixture.

7. The improvement apparatus of claim 6 wherein said means is positioned with respect to said air knife so air from said air knife causes said spray of said gas and liquid mixture to flow along the coated substrate in the direction of said feed path.

8. An apparatus for screeding excess molten metallic coating material from a substrate continuously moving along a feed path and for cooling said coating material, comprising:

a plurality of air knives discharging pressurized air to impinge against said substrate, to remove excess material and to leave a coating of desired thickness and distribution;

an array of cooling nozzles associated with each air knife, for reducing spangle, each array located downstream along the feed path with respect to its associated air knife, each cooling nozzle in an array spraying a gas and liquid mixture substantially in parallel paths with respect to the other nozzles in the array, each array positioned to direct its spray at the approximate location at which the air from its associated air knife impinges the substrate, said discharged air from said air knife materially affecting the flow of each spray.

9. The apparatus of claim 8 wherein the array of coating nozzles is a linear array.

10. The apparatus of claim 9 wherein the spray from each nozzle is of a fan pattern.

11. The apparatus of claim 10 wherein the spray pattern from each nozzle in the array overlaps the spray pattern from an adjacent nozzle.

12. An apparatus for screeding excess coating material from a sheet substrate continuously moving along a feed path and cooling said coating material, said apparatus comprising:

air knives, at least one located on each side of said substrate for removing excess coating material from each side of said substrate by discharging air under pressure and for leaving a coating of desired thickness and distribution on each side of said substrate;

a plurality of linear arrays of cooling nozzles, each nozzle spraying a gas and liquid mixture, each air knife having a corresponding array, each array positioned to direct its spray at an approximate location where the air from the corresponding air knife impinges the substrate, said air from said air knives materially affecting the spray from the corresponding array of cooling nozzles.

13. The apparatus of claim 12 wherein the plurality of linear arrays are positioned with respect to said air knives so air from each air knife causes the spray from the corresponding array of cooling nozzles to flow along the coated substrate surface in the direction of the feed path.

14. A method of coating and cooling a substrate in a manner to reduce spangle, the method comprising steps of:

coating a substrate with a molten coating material, screeding the coating material on the substrate by impinging air from an air knife thereagainst, and directing a gas and liquid spray directly toward the coated substrate at a location sufficiently close to where air from said air knife has impinged the coated substrate to have the air from the air knife materially affect the spray flow.

15. A method of coating and cooling a substrate in a manner to reduce spangle, the method comprising the steps of:

coating a substrate with a molten coating material, screeding the coating material on the substrate by impinging air from an air knife thereagainst, and directing a cooling mixture spray toward the coated substrate at a location sufficiently close to where said air knife has screeded the coating material so that the cooling mixture will be forced to flow along the substrate surface.

16. A method of galvanizing a metal substrate as the substrate moves along a feed path comprising the steps of:

(a) coating the substrate with a molten coating material, (b) directing an air flow from an air knife perpendicular to and across the width of the coated substrate; and (c) directing a flow of air and water mixture from a common nozzle at an angle to said substrate, said mixture directed at the proximate location the air flow from the air knife impinges the substrate so the air from the air knife materially affects the mixture flow.

17. The method of claim 16 wherein the mixture is carried by the air along the substrate surface in the direction of the feed path of the substrate.

18. A method of coating and cooling an elongated metal substrate with a galvanizing material in a manner to inhibit spangle in the coating, the steps comprising:

coating the substrate with a molten metal, screeding the molten metal on the substrate by directing an air flow from an air knife against the coated surface across the width of the surface, and directing a mixed gas and liquid flow from a common nozzle at an angle to said substrate from a location downstream from the location at which the air flow from the air knife originates, said mixture directed at the proximate location the air flow from the air knife impinges the substrate so the air from the air knife materially affects the mixture flow.

* * * * *